US010082812B2

(12) United States Patent
Zhou et al.

(10) Patent No.: US 10,082,812 B2
(45) Date of Patent: Sep. 25, 2018

(54) LOW DROPOUT VOLTAGE REGULATOR

(71) Applicant: Huawei Technologies Co., Ltd., Shenzhen (CN)

(72) Inventors: Bin Zhou, Shanghai (CN); Vladimir Koifman, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 18 days.

(21) Appl. No.: 15/400,777

(22) Filed: Jan. 6, 2017

(65) Prior Publication Data

US 2017/0115680 A1 Apr. 27, 2017

Related U.S. Application Data

(63) Continuation of application No. PCT/EP2014/064699, filed on Jul. 9, 2014.

(51) Int. Cl.

| | |
|---|---|
| ***G05F 1/10*** | (2006.01) |
| ***G05F 1/575*** | (2006.01) |
| *G05F 1/56* | (2006.01) |

(52) U.S. Cl.

CPC ..... *G05F 1/575* (2013.01); *G05F 1/10* (2013.01); *G05F 1/56* (2013.01)

(58) Field of Classification Search

CPC ... G05F 1/10; G05F 1/56; G05F 1/565; G05F 1/575; G05F 1/46; G05F 1/461; G05F 1/467; G05F 1/59; G05F 5/00; G05F 3/08; G05F 3/16; G05F 3/30; G05F 3/242; G05F 3/222

See application file for complete search history.

(56) References Cited

U.S. PATENT DOCUMENTS

| | | | | |
|---|---|---|---|---|
| 4,276,615 | A * | 6/1981 | Kuhnel | G06G 7/24 250/363.02 |
| 5,548,464 | A * | 8/1996 | Manning | H02H 1/06 361/18 |
| 5,831,909 | A * | 11/1998 | Shirley | G11C 7/14 365/149 |
| 6,977,490 | B1 * | 12/2005 | Zhang | G05F 1/575 323/280 |
| 8,169,203 | B1 * | 5/2012 | Vemula | G05F 1/575 323/273 |
| 8,289,009 | B1 * | 10/2012 | Strik | G05F 1/575 323/272 |
| 8,674,672 | B1 | 3/2014 | Johal et al. | |
| 2007/0159146 | A1 * | 7/2007 | Mandal | G05F 1/575 323/280 |
| 2010/0066320 | A1 * | 3/2010 | Dasgupta | G05F 1/56 323/273 |

(Continued)

*Primary Examiner* — Gustavo Rosario Benitez

(74) *Attorney, Agent, or Firm* — Leydig, Voit & Mayer, Ltd.

(57) ABSTRACT

A low dropout voltage regulator includes: a pass element connected between an input terminal and an output terminal of the low dropout voltage regulator; an error amplifier driving a control terminal of the pass element; a first compensation element connected to the output terminal of the low dropout voltage regulator; and a compensation circuit connected to a control terminal (of the first compensation element, wherein the compensation circuit is configured to control a trans-conductance of the first compensation element in accordance with a noise compensation criterion.

14 Claims, 6 Drawing Sheets

(56) References Cited

U.S. PATENT DOCUMENTS

| | | | | |
|---|---|---|---|---|
| 2010/0201331 | A1 | 8/2010 | Imura | |
| 2010/0253303 | A1 | 10/2010 | Chern et al. | |
| 2010/0295524 | A1* | 11/2010 | Sicard | G05F 1/56 323/282 |

* cited by examiner

LOW DROPOUT VOLTAGE REGULATOR

CROSS-REFERENCE TO RELATED APPLICATION

This application is a continuation application of International Patent Application No. PCT/EP2014/064699, filed on Jul. 9, 2014, the disclosure of which is hereby incorporated by reference in its entirety.

TECHNICAL FIELD

The present disclosure relates to a low dropout (LDO) voltage regulator, in particular a full bandwidth high PSRR (power supply rejection ratio) low dropout regulator and a method for low dropout voltage regulation. It finds applications, in particular, in communication systems or any equipment that need large current load and stable voltage supply for high bandwidth.

BACKGROUND

Low dropout linear regulators are usually used to provide a stable power voltage to low-voltage digital circuits, which is independent of input-voltage variations, temperature and time. A main figure of merit for a voltage regulator is its power supply rejection ratio, which is a ratio of the noise present at the power supply of the regulator to the noise at the output of regulator. Typically, the PSRR of an LDO is determined by the gain and bandwidth of the LDO and the output capacitor. At low frequencies, power supply noise can be rejected by the error amplifier itself. However, at high frequencies, the noise reaches beyond the error amplifier bandwidth. PSRR is determined by the ratio of the impedance connected to the output. Particularly, a high PSRR across a wide range of operating frequencies of devices being supplied by a voltage regulator is difficult to achieve.

SUMMARY

It is the object of the invention to provide a low dropout regulator providing a high PSRR across a wide range of operating frequencies.

This object is achieved by the features of the independent claims. Further implementation forms are apparent from the dependent claims, the description and the figures.

In order to describe the invention in detail, the following terms, abbreviations and notations will be used:

LDO: low dropout,
PSRR: power supply rejection ratio,
FET: field effect transistor,
MOSFET: metal oxide semiconductor FET,
JFET junction FET,
OP operational amplifier.

According to a first aspect, the invention relates to a low dropout voltage regulator, comprising: a pass element connected between an input terminal and an output terminal of the low dropout voltage regulator; an error amplifier driving a control terminal of the pass element; a first compensation element connected to the output terminal of the low dropout voltage regulator; and a compensation circuit connected to a control terminal of the first compensation element, wherein the compensation circuit is configured to control a trans-conductance of the first compensation element in accordance with a noise compensation criterion.

When the low dropout regulator uses a first compensation element which trans-conductance is controlled in accordance with a noise compensation criterion, the LDO regulator can provide a high PSRR across a wide range of operating frequencies.

In a first possible implementation form of the low dropout voltage regulator according to the first aspect, the compensation circuit is configured to control the trans-conductance of the first compensation element based on at least one of the following parameters: a trans-conductance of the pass element; a parasitic capacitance at the control terminal of the first compensation element; and a first capacitance connected between the control terminal of the first compensation element and the input terminal of the low dropout voltage regulator.

These parameters determine the noise properties of the LDO regulator. When using these parameters in a noise compensation criterion, noise can be significantly reduced over a wide range of frequencies.

In a second possible implementation form of the low dropout voltage regulator according to the first implementation form of the first aspect, the compensation circuit is configured to control the trans-conductance of the first compensation element based on the following noise compensation criterion:

$$g_{ds0} = g_{m6} \cdot \frac{c_p}{c_0 + c_p},$$

where $g_{ds0}$ denotes the trans-conductance of the pass element, $g_{m6}$ denotes the trans-conductance of the first compensation element, $c_p$ denotes the parasitic capacitance at the control terminal of the first compensation element and $c_0$ denotes the first capacitance connected between the control terminal of the first compensation element and the input terminal of the low dropout voltage regulator.

When using such noise compensation criterion, noise can be significantly reduced over a wide range of frequencies.

In a third possible implementation form of the low dropout voltage regulator according to the first aspect as such or according to any of the preceding implementation forms of the first aspect, the compensation circuit comprises a first circuit, the first circuit comprising: a first resistor; a second compensation element; and a memory cell, wherein the first resistor, the second compensation element and the memory cell are connected in series between the input terminal and a common terminal of the low dropout voltage regulator.

By using a first circuit with a memory cell, a current flowing through the first circuit at a first time instance can be stored in the memory cell and subtracted from a current flowing through the first circuit at a second time instance. The difference of both currents can be used for noise compensation.

In a fourth possible implementation form of the low dropout voltage regulator according to the third implementation form of the first aspect, the memory cell comprises: a memory element; a first switch connected between a first terminal and a control terminal of the memory element; and a capacitance connected between a second terminal and the control terminal of the memory element.

Such implementation with a memory element, a switch and a capacitance can be easily implemented, in particular when space is limited.

In a fifth possible implementation form of the low dropout voltage regulator according to any of the third and the fourth implementation forms of the first aspect, the memory cell is configured to store a first current flowing through the second compensation element.

The memory cell storing a first current flowing through the second compensation element can memorize and reproduce such current. The stored current can be used for noise compensation.

In a sixth possible implementation form of the low dropout voltage regulator according to the fifth implementation form of the first aspect, the first circuit comprises a further first switch connected across the first resistor.

The further first switch can be used for bridging the first resistor such that the first current flowing through the second compensation element is stored in the memory cell.

In a seventh possible implementation form of the low dropout voltage regulator according to the sixth implementation form of the first aspect, the compensation circuit is configured to control the first switch and the further first switch such that the memory cell stores the first current during a first switching state and outputs the stored first current during a second switching state.

When the compensation circuit controls the switching, the switching frequency, i.e. a frequency of switching between the first switching state and the second switching state can be determined such that the noise is minimal over a desired frequency band.

In an eighth possible implementation form of the low dropout voltage regulator according to the seventh implementation form of the first aspect, the compensation circuit comprises a second circuit connected by a second switch between the memory cell and the control terminal of the first compensation element.

The second circuit can be used for injecting an error determined by the first circuit to the first compensation element. By such error injection an improved noise performance of the low dropout voltage regulator can be achieved.

In a ninth possible implementation form of the low dropout voltage regulator according to the eighth implementation form of the first aspect, the compensation circuit is configured to control the second switch such that during the second switching state a difference of the first current and the stored first current is injected via the second circuit to the control terminal of the first compensation element.

The difference of the first current and the stored first current may be used as a measure for the noise. By injecting such difference to the control terminal of the first compensation element results an efficient noise feedback structure can be implemented.

In a tenth possible implementation form of the low dropout voltage regulator according to the ninth implementation form of the first aspect, the second circuit comprises: a second resistor connected to the input terminal of the low dropout voltage regulator; a third resistor connected to the control terminal of the first compensation element; a third compensation element; and a fourth compensation element, wherein the second resistor is connected in series with the third resistor, and wherein the third resistor is connected between a control terminal of the third compensation element and a control terminal of the fourth compensation element.

By such a construction a balance of a current flowing through the first resistor and a current flowing through the third resistor can be reached, thereby providing stable behavior and avoiding overdriving.

In an eleventh possible implementation form of the low dropout voltage regulator according to the tenth implementation form of the first aspect, the second circuit further comprises: a fifth compensation element connected in series with the third resistor between the input terminal of the low dropout voltage regulator and the control terminal of the first compensation element; and a current mirror connected between the input terminal of the low dropout voltage regulator and first terminals of the third and fourth compensation elements.

The fifth compensation element and the current mirror further improve stability of the LDO regulator.

In a twelfth possible implementation form of the low dropout voltage regulator according to the eleventh implementation form of the first aspect, the second circuit is designed to provide a current $I_5$ flowing through the fifth compensation element and a current $I_1$ flowing through the first resistor based on a trans-conductance $g_{m4,3}$ of one of the third and the fourth compensation element and a trans-conductance $g_{ds1}$ of the second compensation element, in particular according to the relation: $g_{m4,3} \cdot I_5 R_3 = g_{ds1} \cdot I_1 R_1$, where $R_3$ denotes the third resistor and $R_1$ denotes the first resistor.

Using such design, the current $I_5$ can be proportional to the current $I_1$, i.e. the second circuit 103 can run synchronous with the first circuit 102, thereby achieving an improved noise compensation of the LDO regulator.

According to a second aspect, the invention relates to a method for low dropout voltage regulation, comprising: passing an input voltage at an input terminal to an output voltage at an output terminal through a pass element connected between the input terminal and the output terminal; driving a control terminal of the pass element by an error amplifier; compensating noise by a first compensation element connected to the output terminal; and controlling a trans-conductance of the first compensation element in accordance with a noise compensation criterion.

When compensating noise by a first compensation element which trans-conductance is controlled in accordance with a noise compensation criterion, the LDO voltage regulation can provide a high PSRR across a wide range of operating frequencies.

In a first possible implementation form of the method according to the second aspect, the method comprises: controlling the trans-conductance of the first compensation element based on current memorizing and current reproducing.

By the steps of current memorizing and current reproducing noise can be significantly reduced over a wide range of frequencies.

BRIEF DESCRIPTION OF THE DRAWINGS

Further embodiments of the invention will be described with respect to the following figures, in which.

DETAILED DESCRIPTION OF EMBODIMENTS

Figure 1:
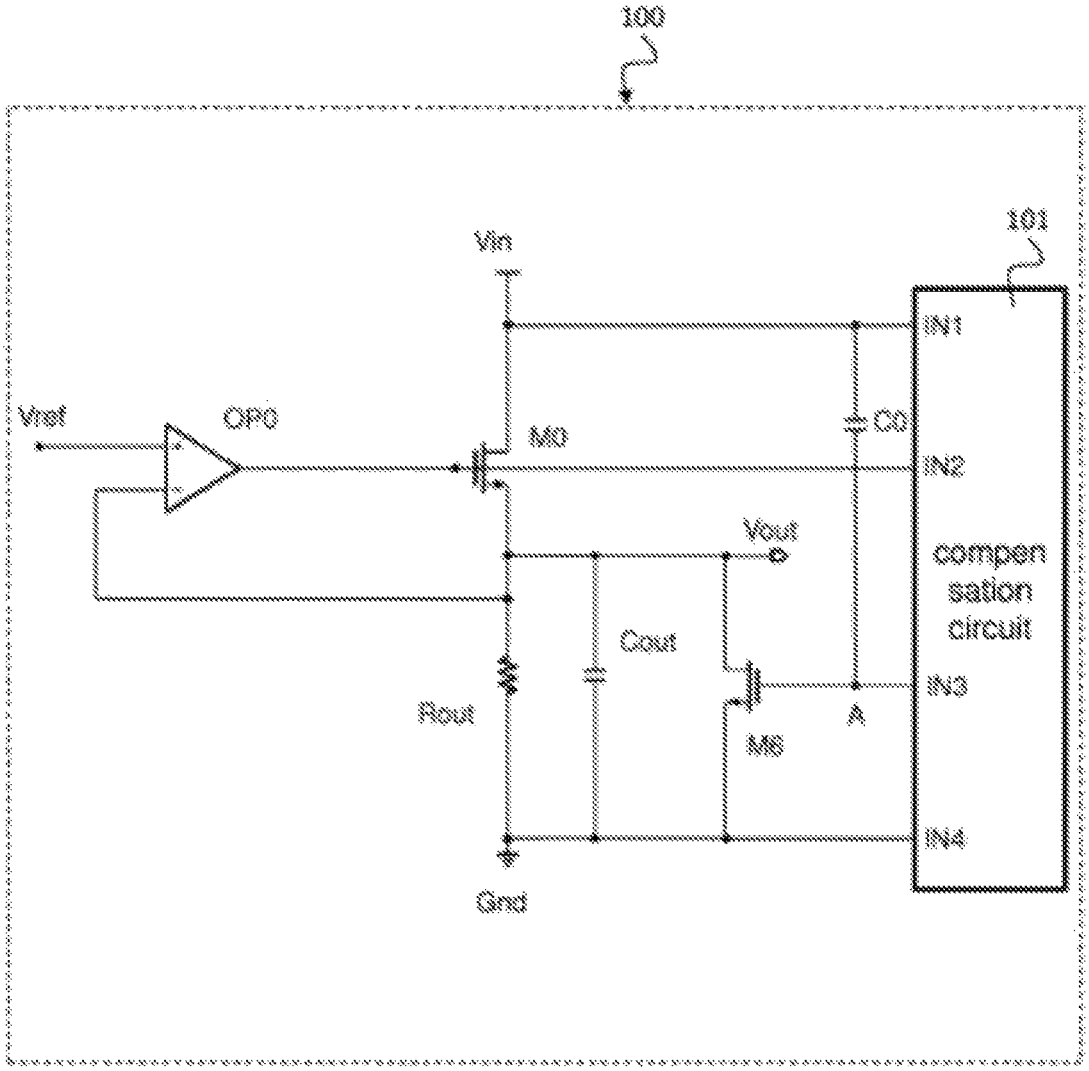
FIG. 1 shows a block diagram illustrating a low dropout voltage regulator 100 according to an implementation form.

In the following detailed description, reference is made to the accompanying drawings, which form a part thereof, and in which is shown by way of illustration specific aspects in which the disclosure may be practiced. It is understood that other aspects may be utilized and structural or logical changes may be made without departing from the scope of the present disclosure. The following detailed description, therefore, is not to be taken in a limiting sense, and the scope of the present disclosure is defined by the appended claims.

The devices and methods described herein may be based on low dropout regulators or low dropout voltage regulators. It is understood that comments made in connection with a described method may also hold true for a corresponding device or system configured to perform the method and vice versa. For example, if a specific method step is described, a corresponding device may include a unit to perform the described method step, even if such unit is not explicitly described or illustrated in the figures. Further, it is understood that the features of the various exemplary aspects described herein may be combined with each other, unless specifically noted otherwise.

The methods and devices described herein may be implemented for low dropout regulation. The described devices and systems may include software units and hardware units. The described devices and systems may include integrated circuits and/or passives and may be manufactured according to various technologies. For example, the circuits may be designed as logic integrated circuits, analog integrated circuits, mixed signal integrated circuits, optical circuits, memory circuits and/or integrated passives.

In the following detailed description, pass elements, compensation elements, memory elements, compensation circuits and error amplifiers are described. A pass element is an electronic component that may be used for passing a current or a voltage through the electronic component. A pass element may be realized as a switch or a transistor, for example a FET (field effect transistor), e.g. a MOSFET (metal oxide semiconductor FET). A control terminal of a pass element may be a control electrode of a transistor, e.g. a gate electrode of a FET. A first terminal of a pass element may be a first electrode of a transistor, e.g. a source electrode of a FET. A second terminal of a pass element may be a second electrode of a transistor, e.g. a drain electrode of a FET. A compensation element is an electronic component that may be used for noise and/or interference compensation. A compensation element may be realized as a switch or a transistor, for example a FET (field effect transistor), e.g. a MOSFET (metal oxide semiconductor FET). A control terminal of a compensation element may be a control electrode of a transistor, e.g. a gate electrode of a FET. A first terminal of a compensation element may be a first electrode of a transistor, e.g. a source electrode of a FET. A second terminal of a compensation element may be a second electrode of a transistor, e.g. a drain electrode of a FET. A memory element is an electronic component that may be used for storing a current or a voltage. A memory element may be realized as a transistor, for example a FET (field effect transistor), e.g. a MOSFET (metal oxide semiconductor FET). A control terminal of a memory element may be a control electrode of a transistor, e.g. a gate electrode of a FET. A first terminal of a memory element may be a first electrode of a transistor, e.g. a source electrode or a drain electrode of a FET. A second terminal of a memory element may be a second electrode of a transistor, e.g. a drain electrode or a source electrode of a FET. A compensation circuit is an electronic circuit that may be used for noise and/or interference compensation. An error amplifier is an amplifier that may be used for amplifying an error, e.g. a difference between two inputs of the amplifier. An error amplifier may be realized as an operational amplifier (OP), for example an OP implemented by a transistor circuit.

In the following detailed description, trans-conductance of electronic components is described. Trans-conductance is a property of certain electronic components. Trans-conductance may be defined as the ratio of the current variation at the output to the voltage variation at the input of the electronic component. It is written as $g_m$. For direct current (DC), trans-conductance may be defined as $g_m=\Delta I_{out}/\Delta V_{in}$. For small signal alternating current, trans-conductance may be defined as $g_m=i_{out}/V_{in}$. In field effect transistors and MOSFETs in particular, trans-conductance may be defined as the change in the drain current divided by the small change in the gate/source voltage with a constant drain/source voltage. The trans-conductance for the MOSFET may be expressed as $g_m=2I_D/V_{eff}$ where $I_D$ is the DC drain current at the bias point, and $V_{eff}$ is the effective voltage, which is the difference between the bias point gate-source voltage and the threshold voltage (i.e., $V_{eff}=V_{GS}-V_{th}$). The trans-conductance for the junction FET may be expressed as $g_m=(2I_{DSS}/|V_p|)(1-V_{GS}/V_p)$, where $V_p$ is the pinch-off voltage and $I_{DSS}$ is the maximum drain current. The trans-conductance for a bipolar transistor may be expressed as $g_m=I_C/V_T$, where $I_C$ denotes the DC collector current at the Q-point, and $V_T$ denotes the thermal voltage.

In the following detailed description, a low dropout regulator providing a high PSRR across a wide range of operating frequencies is described. Power Supply Rejection Ratio or Power Supply Ripple Rejection (PSRR) is a measure of a circuit's power supply's rejection that may be expressed as a log ratio of output noise to input noise. PSRR provides a measure of how well a circuit rejects ripple, of various frequencies, injected at its input. The ripple can be either from the input supply or can be a switching ripple from a DC/DC converter, or can be a ripple due to the sharing of an input supply between different circuit blocks on the board. In the case of LDO regulators, PSRR describes a measure of the regulated output voltage ripple compared to the input voltage ripple over a wide frequency range (e.g. 10 Hz to 1 MHz) and may be expressed in decibels (dB).

FIG. 1 shows a block diagram illustrating a low dropout voltage regulator 100 according to an implementation form. The low dropout voltage regulator 100 includes a pass element M0 connected between an input terminal Vin and an output terminal Vout of the low dropout voltage regulator 100. The low dropout voltage regulator 100 includes an error amplifier OP0 driving a control terminal of the pass element M0. The error amplifier OP0 may include a first input (+) connected to a reference voltage terminal Vref and a second input (−) connected to the output terminal Vout. The low dropout voltage regulator 100 includes a first compensation element M6 connected to the output terminal Vout of the low dropout voltage regulator 100. A first terminal of the first compensation element M6 may be connected to the output terminal Vout, a second terminal of the first compensation element M6 may be connected to a common terminal Gnd, for example a ground terminal. The low dropout voltage regulator 100 includes a compensation circuit 101 connected to a control terminal (denoted hereinafter by node A) of the first compensation element M6. The compensation circuit 101 may include a first input IN1 connected to the input terminal Vin, a second input IN2 connected to the control terminal of the pass element M0, a third input IN3 connected to the control terminal A of the first compensation element M6 and a fourth input IN4 connected to the common terminal Gnd. A first capacitance C0 (also denoted as $c_0$) may be connected between the first input IN1 and the third input IN3 of the compensation circuit 101, i.e. between the control terminal A of the first compensation element M6 and the input terminal Vin of the low dropout voltage regulator. An output capacitance Cout may be connected in parallel with an output resistance Rout between the output terminal Vout and the common terminal Gnd. The compensation circuit 101 is configured to control a trans-conductance $g_{m6}$ of the first compensation element M6 in accordance with a noise compensation criterion.

The compensation circuit 101 may be configured to control the trans-conductance $g_{m6}$ of the first compensation element M6 based on one of the following parameters: a trans-conductance $g_{ds0}$ of the pass element M0, a parasitic capacitance $c_p$ at the control terminal A of the first compensation element M6, and the first capacitance $c_0$ that may be connected between the control terminal A of the first compensation element M6 and the input terminal Vin of the low dropout voltage regulator. The compensation circuit 101 may be configured to control the trans-conductance $g_{m6}$ of the first compensation element M6 based on the following noise compensation criterion:

$$g_{ds0} = g_{m6} \cdot \frac{c_p}{c_0 + c_p}, \tag{1}$$

where $g_{ds0}$ denotes the trans-conductance of the pass element M0, $g_{m6}$ denotes the trans-conductance of the first compensation element M6, $c_p$ denotes the parasitic capacitance at the control terminal of the first compensation element M6 and $c_0$ denotes the first capacitance connected between the control terminal A of the first compensation element M6 and the input terminal Vin of the low dropout voltage regulator 100.

Figure 2:
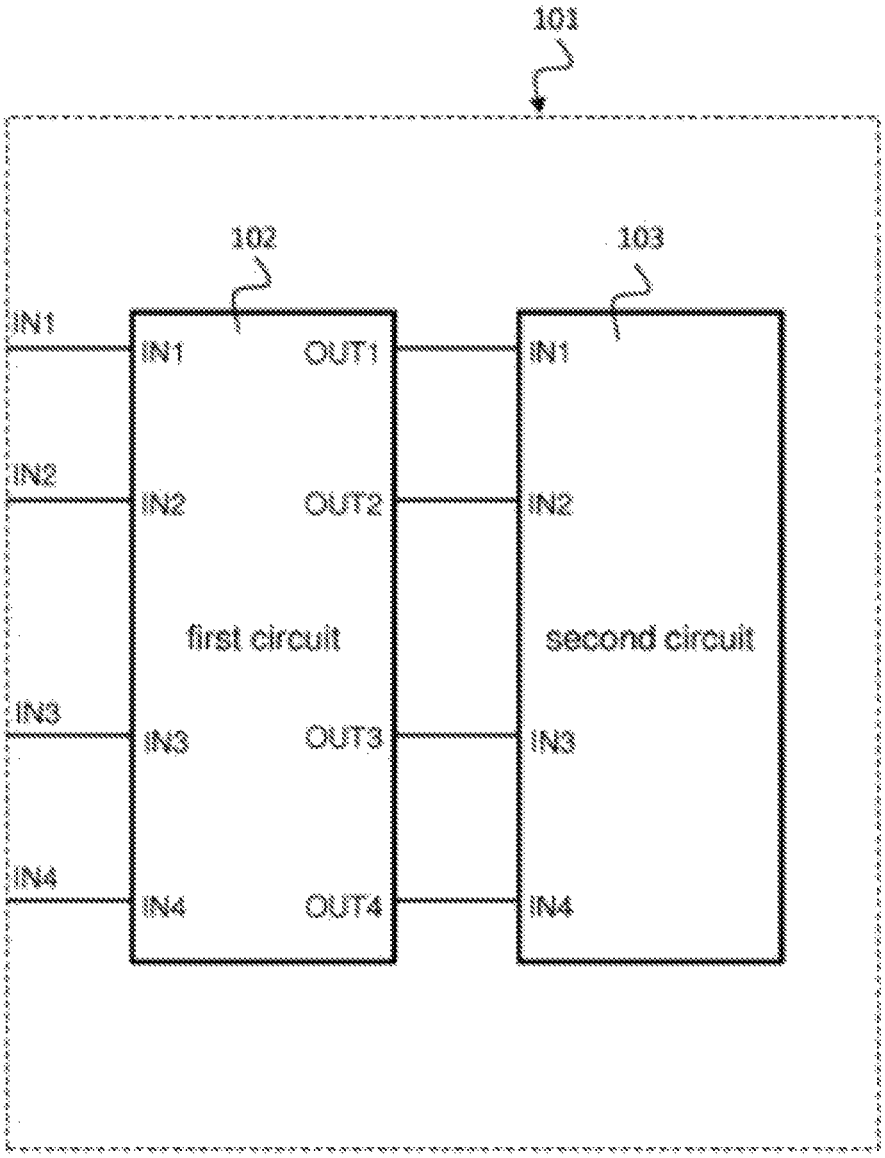
FIG. 2 shows a block diagram illustrating a compensation circuit 101 of a low dropout voltage regulator according to an implementation form.

FIG. 2 shows a block diagram illustrating a compensation circuit 101 of a low dropout voltage regulator according to an implementation form. The compensation circuit 101 may be connected to a control terminal of a low dropout voltage regulator 100 as described above with respect to FIG. 1. In particular, the compensation circuit 101 may include a first input IN1 connected to the input terminal Vin, a second input IN2 connected to the control terminal of the pass element M0, a third input IN3 connected to the control terminal A of the first compensation element M6 and a fourth input IN4 connected to the common terminal Gnd. The compensation circuit 101 includes a first circuit 102 and a second circuit 103. First circuit 102 and second circuit 103 are connected such that: a first input IN1 of the second circuit 103 is connected to a first output OUT1 of the first circuit 102 and a first input IN1 of the first circuit 102 is connected to the first input IN1 of the compensation circuit 101; a second input IN2 of the second circuit 103 is connected to a second output OUT2 of the first circuit 102 and a second input IN2 of the first circuit 102 is connected to the second input IN2 of the compensation circuit 101; a third input IN3 of the second circuit 103 is connected to a third output OUT3 of the first circuit 102 and a third input IN3 of the first circuit 102 is connected to the third input IN3 of the compensation circuit 101; and a fourth input IN4 of the second circuit 103 is connected to a fourth output OUT4 of the first circuit 102 and a fourth input IN4 of the first circuit 102 is connected to the fourth input IN4 of the compensation circuit 101. A possible realization of the first circuit 102 is described below with respect to FIG. 3 and of the second circuit 103 is described below with respect to FIG. 4.

Figure 3:
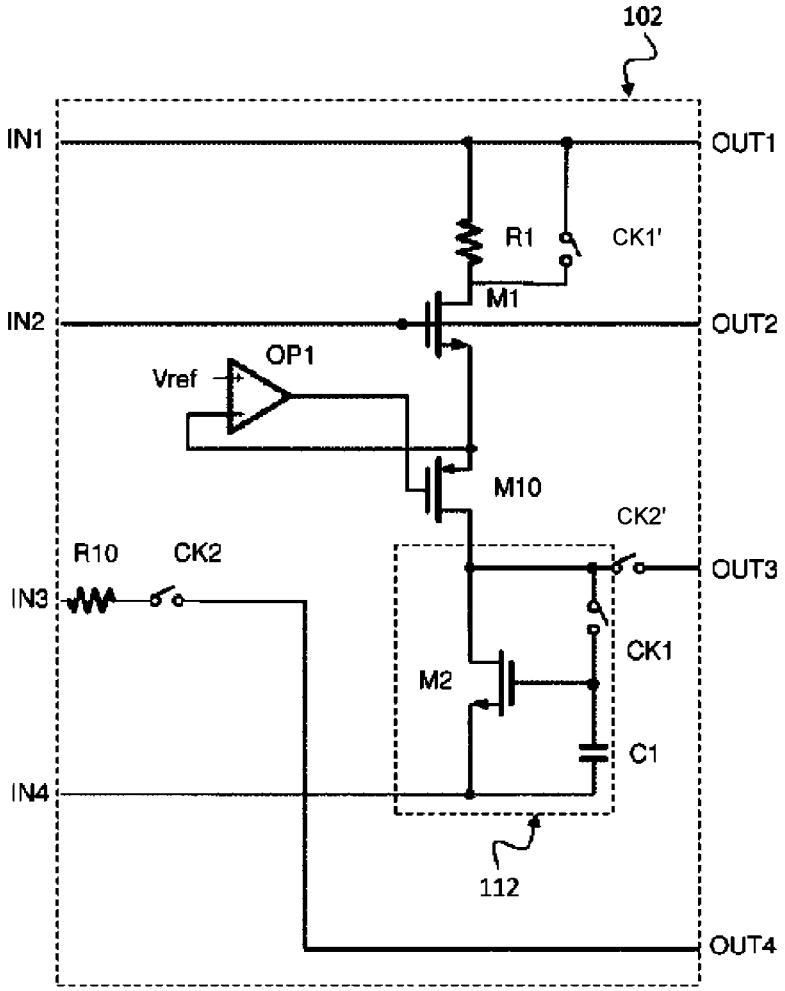
FIG. 3 shows a block diagram illustrating a first circuit 102 of the compensation circuit 101 depicted in FIG. 2 according to an implementation form.

FIG. 3 shows a block diagram illustrating a first circuit 102 of the compensation circuit 101 depicted in FIG. 2 according to an implementation form. The first circuit 101 includes a first resistor R1, a second compensation element M1 and a memory cell 112. The first resistor R1, the second compensation element M1 and the memory cell 112 are connected in series between the first input IN1 and the fourth input IN4 of the first circuit 101, i.e. between the input terminal Vin and the common terminal Gnd of the low dropout voltage regulator 100 when the compensation circuit 101 is arranged in the low dropout voltage regulator 100 as described above with respect to FIG. 1.

The memory cell 112 includes: a memory element M2; a first switch CK1/CK1' connected between a first terminal, e.g. a drain electrode, and a control terminal of the memory element; and a capacitance C1 connected between a second terminal, e.g. a source electrode, and the control terminal of the memory element M2. A second pass element M10 having a control terminal driven by a second error amplifier OP1 may be connected between the second compensation element M1 and the memory cell 112.

The first input IN1 of the first circuit 102 may be connected to the first output OUT1 of the first circuit 102. The second input IN2 of the first circuit 102 may be connected to the control terminal of the second compensation element M1 and to the second output OUT2 of the first circuit 102. The third input IN3 of the first circuit 102 may be connected via a series connection of a resistor R10 and a second switch CK2/CK2' to the fourth output OUT4 of the first circuit 102. The fourth input IN4 of the first circuit 102 may be connected to the memory cell 112, in particular to the second terminal of the memory element M2. The third output OUT3 of the first circuit 102 may be connected via the second switch CK2/CK2' to the memory cell 112, in particular to the first terminal of the memory element M2.

The first circuit 102 may include a further first switch CK1/CK1' connected across the first resistor R1. The first switch and the further first switch are denoted as CK1/CK1' and may be synchronously switched. The second switch and the further second switch are denoted as CK2/CK2' and may be synchronously switched. Switching of the first switches CK1/CK1' may differ from switching of the second switches CK2/CK2'.

The memory cell 112 may be configured to store a first current I1 flowing through the second compensation element M1. The compensation circuit 101 may be configured to control the first switch CK1/CK1' and the further first switch CK1/CK1' such that the memory cell 112 stores the first current I1 during a first switching state and outputs the stored first current I1*o* during a second switching state.

The memory cell 112 is capable of memorizing and reproducing a current through the memory element M2. In one operation mode the following switching states can be used to describe the processing of the memory cell 112: When CK1/CK1' is on and CK2/CK2' is off, the current which flows through M1 is maintained by the current memory cell M2 (first switching state). When CK1/CK1' is off and CK2/CK2' is on, the current difference $\Delta I_1$ will be injected (second switching state).

Figure 4:
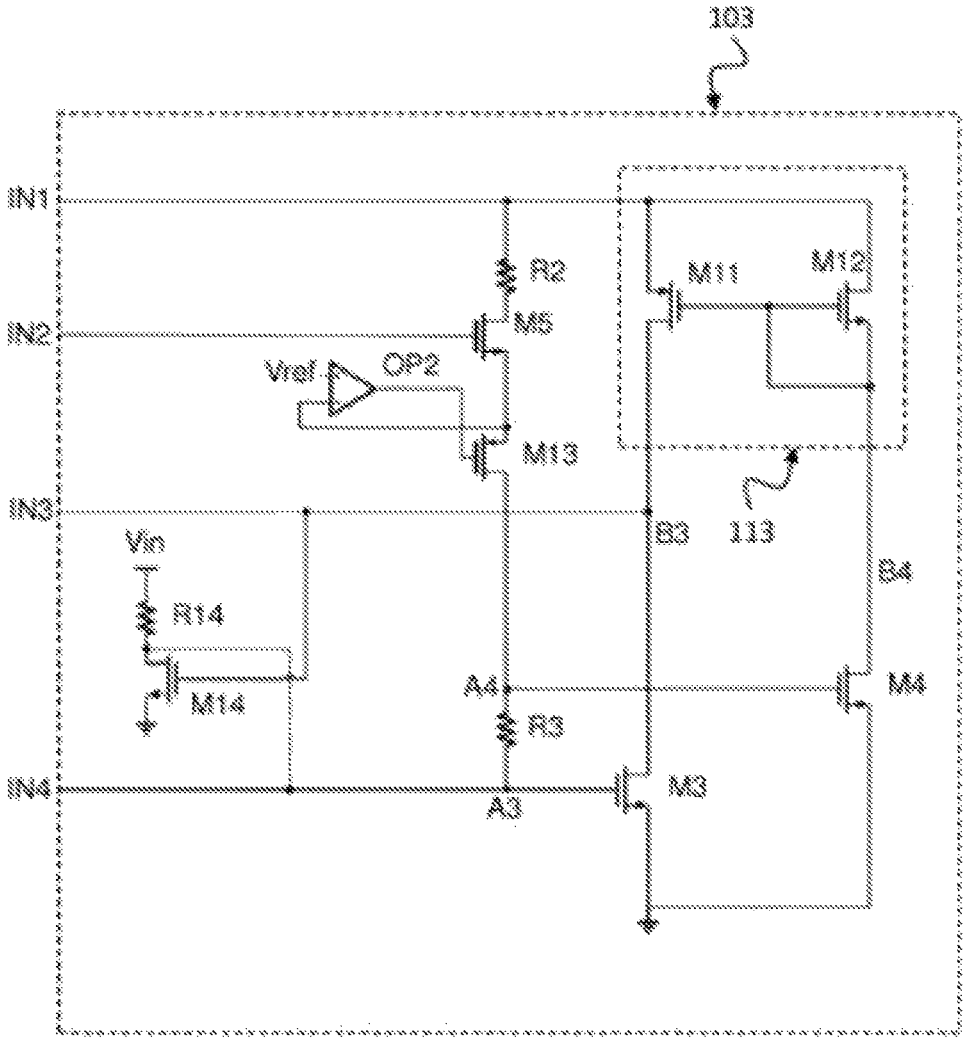
FIG. 4 shows a block diagram illustrating a second circuit 103 of the compensation circuit 101 depicted in FIG. 2 according to an implementation form.

FIG. 4 shows a block diagram illustrating a second circuit 103 of the compensation circuit 101 depicted in FIG. 2 according to an implementation form. The second circuit 103 may be connected by the second switch CK2 and the resistor R10 between the memory cell 112 and the control terminal A of the first compensation element M6 when the second circuit 103 is connected to the first circuit 102. The compensation circuit 101 may be configured to control the second switch CK2 such that during the second switching state a difference of the first current I1 and the stored first current I1*o* is injected via the second circuit 103 to the control terminal of the first compensation element M6.

The second circuit 103 may include a second resistor R2 connected to the input terminal Vin of the low dropout voltage regulator; a third resistor R3 connected to the control terminal A of the first compensation element M6; a third compensation element M3; and a fourth compensation element (M4). The second resistor R2 may be connected in series with the third resistor R3. The third resistor R3 may be connected between a control terminal A3 of the third compensation element M3 and a control terminal A4 of the fourth compensation element M4. The second circuit 103 may include a fifth compensation element M5 connected in series with the third resistor R3 between the input terminal Vin of the low dropout voltage regulator and the control terminal A of the first compensation element M6. The second circuit 103 may include a current mirror 113 connected between the input terminal Vin of the low dropout voltage regulator and first terminals of the third M3 and fourth M4 compensation elements.

A third pass element M13 having a control terminal driven by a third error amplifier OP2 may be connected between the fifth compensation element M5 and the third resistor R3.

The first input IN1 of the second circuit 103 may be connected to the current mirror 113 and to the second resistor R2. The second input IN2 of the second circuit 103 may be connected to the control terminal of the fifth compensation element M5. The third input IN3 of the second circuit 103 may be connected to a first output B3 of the current mirror 113 and to a first terminal of the third compensation element M3. The fourth input IN4 of the second circuit 103 may be connected to the control terminal of the third compensation element M3.

The second circuit 102 may be designed to provide a current $I_5$ flowing through the fifth compensation element M5 and a current $I_1$ flowing through the first resistor R1 based on a trans-conductance $g_{m4,3}$ of one of the third M3 and the fourth M4 compensation element and a trans-conductance $g_{ds1}$ of the second compensation element (M1), in particular according to the relation: $g_{m4,3} \cdot I_5 R_3 = g_{ds1} \cdot I_1 R_1$, where $R_1$ denotes the first resistor and $R_3$ denotes the third resistor.

Figure 5:
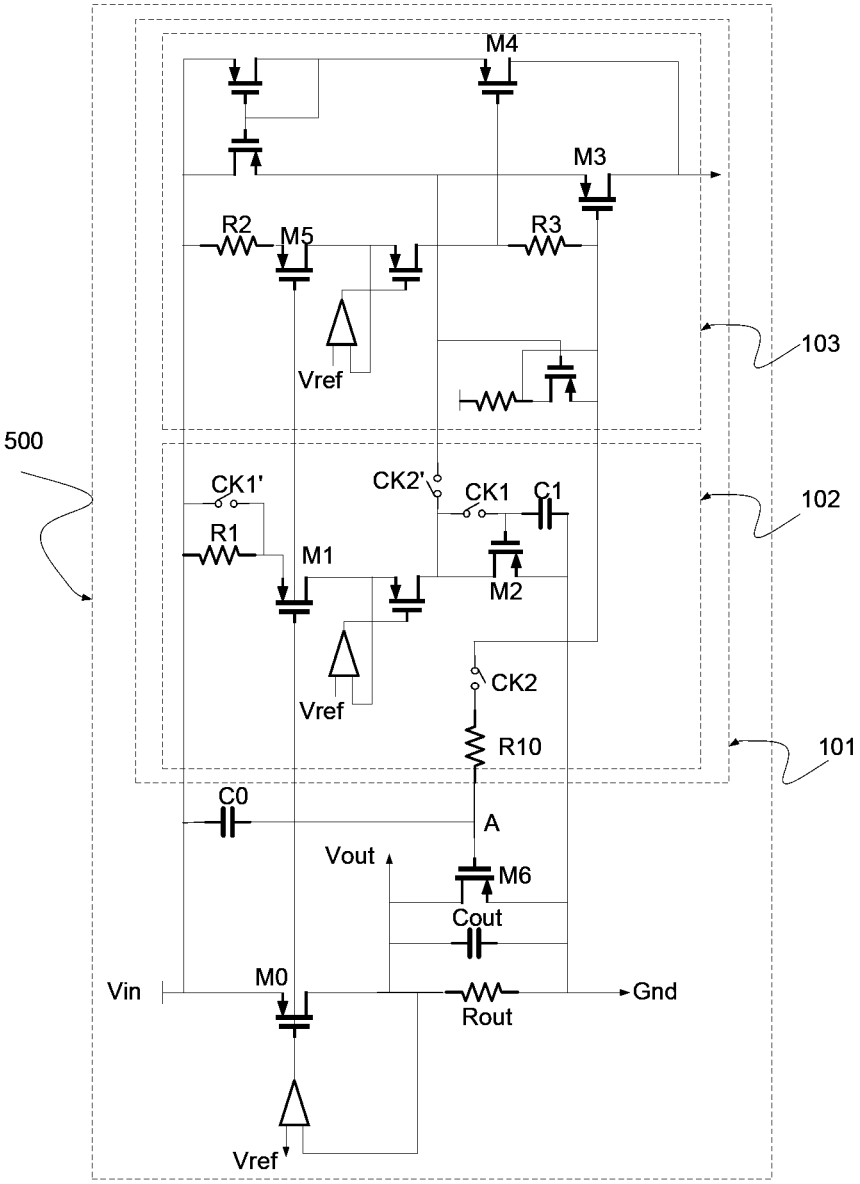
FIG. 5 shows a block diagram illustrating a low dropout voltage regulator 500 according to an implementation form.

FIG. 5 shows a block diagram illustrating a low dropout voltage regulator 500 according to an implementation form.

The low dropout voltage regulator 500 may correspond to the low dropout voltage regulator 100 described above with respect to FIG. 1 when the compensation circuit 101 includes the first circuit 102 as described above with respect to FIG. 3 and the second circuit 103 as described above with respect to FIG. 4 which are connected according to the representation of FIG. 2.

The behavior of the low dropout voltage regulator 500 is described in the following. The current memory cell includes CK1, C1 and M2 and is capable of memorizing and reproducing a current through M2. When CK1 is on and CK2 is off, the current which flows through M1 is maintained by the current memory cell M2. When CK1 is off and CK2 is on, the current difference $\Delta I_1$ will be injected. In order to compensate the noise from the power at high frequency band, the following relationship holds between M0 and M6:

$$g_{ds0} = g_{m6} \cdot \frac{c_p}{c_0 + c_p}, \tag{1}$$

where Cp is the parasitic capacitor from node A to ground.

The current difference between M3 and M4 can be expressed as:

$$I_4 - I_3 = g_{m4} V_{gs4} - g_{m3} V_{gs3} \tag{2}$$

M3 and M4 are both in sub-threshold region and their trans-conductance is close enough, i.e. it holds:

$$g_{m4} \approx g_{m3} \triangleq g_{m4,3} \tag{3}$$

$$I_4 - I_3 = g_{m4,3}'(V_{gs4} - V_{gs3}) \tag{4}$$

The drain-source voltage Vds of M1 is changed according to the voltage across R1 as described by the following equations:

$$\Delta I_1 = g_{ds1} \cdot \Delta V_{ds1} = g_{ds1} \cdot I_1 R_1 \tag{5}$$

$$R_1 = R_2 = R_3 \tag{6}$$

$$g_{m4,3} \cdot I_5 R_3 = g_{ds1} \cdot I_1 R_1 \tag{7}$$

$$g_{m4,3} = g_{ds1} \tag{8}$$

$$g_{m6} \sim g_{m4,3} = g_{ds2,1} \sim g_{ds0} \tag{9}$$

The connection between M0 and M6 can be setup by equation (8).

The low dropout voltage regulator 500 shows stable performance, in particular when applying current loading of e.g. 60 mA and even when applying current loading changing, e.g. in the range between 0 and 60 mA. Tests have shown that when adding a sine wave with 10 mV amplitude and 48 MHz frequency as distortion and using a clock frequency of 1 MHz for the compensation circuit 101 the low dropout voltage regulator 500 may provide a PSRR in the range between 30 dB and 43 dB. The low dropout voltage regulator 500 avoids overdriving in the start-up sequence.

Figure 6:
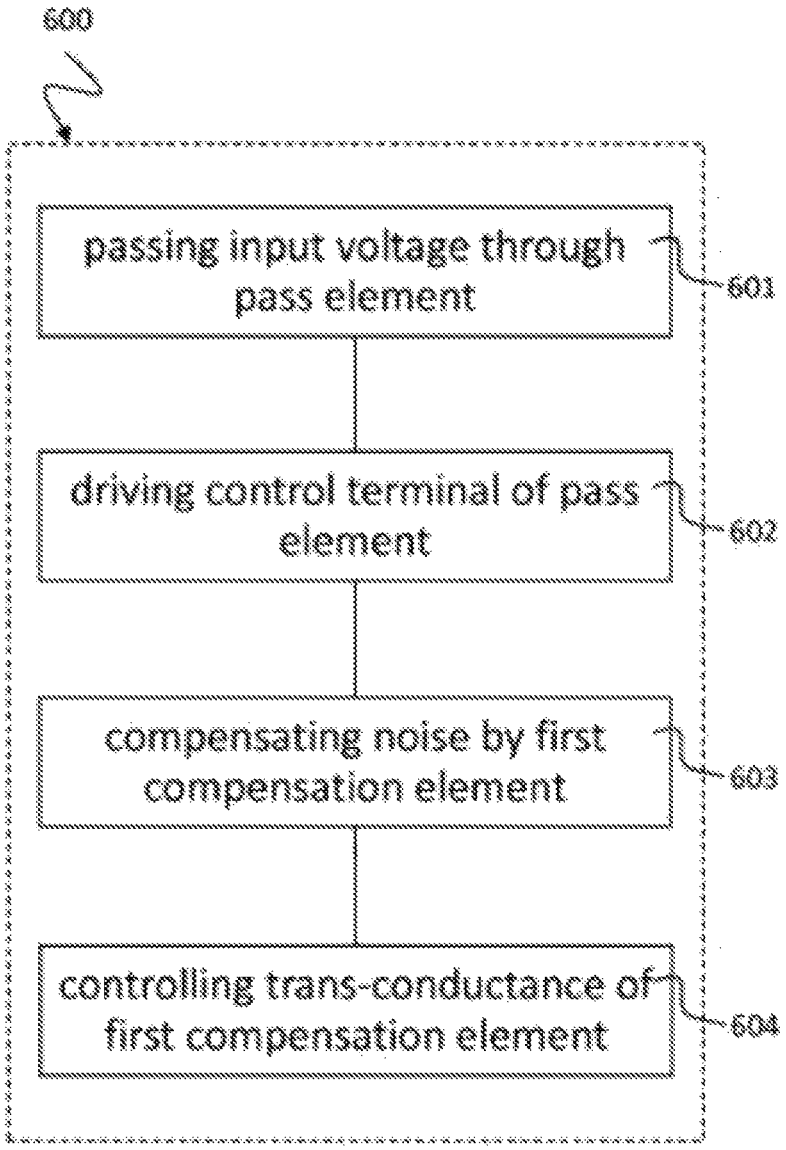
FIG. 6 shows a schematic diagram illustrating a method 600 for low dropout voltage regulation according to an implementation form.

FIG. 6 shows a schematic diagram illustrating a method 600 for low dropout voltage regulation according to an implementation form. The method 600 includes passing 601 an input voltage at an input terminal Vin to an output voltage at an output terminal Vout through a pass element M0 connected between the input terminal Vin and the output terminal Vout, e.g. a pass element M0 as described above with respect to FIGS. 1 to 5. The method 600 includes driving 602 a control terminal of the pass element M0 by an error amplifier OP0. The method 600 includes compensating 603 noise by a first compensation element M6 connected to the output terminal Vout, e.g. a first compensation element M6 as described above with respect to FIGS. 1 to 5. The method 600 includes controlling 604 a trans-conductance $g_{M6}$ of the first compensation element M6 in accordance with a noise compensation criterion, e.g. as described above with respect to FIGS. 1 to 5. The method 600 may include controlling the trans-conductance $g_{M6}$ of the first compensation element M6 based on current memorizing and current reproducing, e.g. by using a memory cell 112 as described above with respect to FIG. 3 and FIG. 5.

The methods, systems and devices described herein may be implemented as hardware circuit within a chip or an integrated circuit or an application specific integrated circuit (ASIC) of a Digital Signal Processor (DSP). The invention can be implemented in digital and/or analogue electronic circuitry.

While a particular feature or aspect of the disclosure may have been disclosed with respect to only one of several implementations, such feature or aspect may be combined with one or more other features or aspects of the other implementations as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the invention beyond those described herein. While the present invention has been described with reference to one or more particular embodiments, those skilled in the art recognize that many changes may be made thereto without departing from the scope of the present invention. It is therefore to be understood that within the scope of the appended claims and their equivalents, the invention may be practiced otherwise than as specifically described herein.

What is claimed is:

1. A low dropout voltage regulator comprising:

a pass element connected between an input terminal and an output terminal of the low dropout voltage regulator;

an error amplifier driving a control terminal of the pass element;

a first compensation element connected to the output terminal of the low dropout voltage regulator; and a compensation circuit connected to a control terminal of the first compensation element, wherein the compensation circuit is configured to control a trans-conductance of the first compensation element in accordance with a noise compensation criterion that includes a trans-conductance $g_{ds0}$ of the pass element, where $g_{ds0}$ is substantially equal to:

$$g_{m6} \cdot \frac{c_p}{c_0 + c_p},$$

where $g_{m6}$ denotes a trans-conductance of the first compensation element, $c_p$ denotes a parasitic capacitance at the control terminal of the first compensation element and $c_O$ denotes a capacitance connected between the control terminal of the first compensation element and the input terminal.

2. The low dropout voltage regulator of claim 1, wherein the compensation circuit comprises a first circuit, the first circuit comprising:

a first resistor;

a second compensation element; and a memory cell, wherein the first resistor, the second compensation element and the memory cell are connected in series between the input terminal and a common terminal of the low dropout voltage regulator.

3. The low dropout voltage regulator of claim 2, wherein the memory cell comprises:

a memory element;

a first switch connected between a first terminal and a control terminal of the memory element; and a capacitance connected between a second terminal and the control terminal of the memory element.

4. The low dropout voltage regulator of claim 3, wherein the memory cell is configured to store a first current flowing through the second compensation element.

5. The low dropout voltage regulator of claim 4, wherein the first circuit comprises a further first switch connected across the first resistor.

6. The low dropout voltage regulator of claim 5, wherein the compensation circuit is configured to control the first switch and the further first switch such that the memory cell stores the first current during a first switching state and outputs the stored first current during a second switching state.

7. The low dropout voltage regulator of claim 6, wherein the compensation circuit comprises a second circuit connected by a second switch between the memory cell and the control terminal of the first compensation element.

8. The low dropout voltage regulator of claim 7, wherein the compensation circuit is configured to control the second switch such that during the second switching state a difference of the first current and the stored first current is injected via the second circuit to the control terminal of the first compensation element.

9. The low dropout voltage regulator of claim 8, wherein the second circuit comprises:

a second resistor connected to the input terminal of the low dropout voltage regulator;

a third resistor connected to the control terminal of the first compensation element;

a third compensation element; and a fourth compensation element, wherein the second resistor is connected in series with the third resistor, and wherein the third resistor is connected between a control terminal of the third compensation element and a control terminal of the fourth compensation element.

10. The low dropout voltage regulator of claim 9, wherein the second circuit further comprises:

a fifth compensation element connected in series with the third resistor between the input terminal of the low dropout voltage regulator and the control terminal of the first compensation element; and a current mirror connected between the input terminal of the low dropout voltage regulator and first terminals of the third and fourth compensation elements.

11. The low dropout voltage regulator of claim 10, wherein the second circuit is designed to provide a current $I_5$ flowing through the fifth compensation element and a current $I_1$ flowing through the first resistor based on a trans-conductance $g_{m4,3}$ of one of the third and the fourth compensation element and a trans-conductance $g_{ds1}$ of the second compensation element, substantially according to the relation:

$$g_{m4,3} \cdot I_5 R_3 = g_{ds1} \cdot I_1 R_1,$$

where $R_1$ and $R_3$ denote the first and third resistors, respectively.

12. A method for low dropout voltage regulation, the method comprising:

passing an input voltage at an input terminal to an output voltage at an output terminal through a pass element connected between the input terminal and the output terminal;

driving a control terminal of the pass element by an error amplifier;

compensating noise by a compensation element connected to the output terminal; and controlling a trans-conductance of the compensation element in accordance with a noise compensation criterion that includes a trans-conductance of the pass element $g_{ds0}$ substantially equal to:

$$g_{m6} \cdot \frac{c_p}{c_0 + c_p},$$

where $g_{m6}$ denotes a trans-conductance of the compensation element, $c_p$ denotes a parasitic capacitance at the control terminal of the first compensation element and $c_O$ denotes a capacitance connected between the control terminal of the first compensation element and the input terminal.

13. The method for low dropout voltage regulation of claim 12 including controlling a first switch such that a memory cell stores a first current during a first switching state and outputs the stored first current during a second switching state.

14. The method for low dropout voltage regulation of claim 13 including controlling a second switch such that during the second switching state a difference of the first current and the stored first current is injected into the control terminal of the first compensation element.

* * * * *